US008028837B2

(12) United States Patent
Gerstle et al.

(10) Patent No.: US 8,028,837 B2
(45) Date of Patent: Oct. 4, 2011

(54) BREAK-OPEN PACKAGE WITH SHAPED DIE CUT FOR STORING AND DISPENSING SUBSTRATES

(75) Inventors: Matthew Edward Gerstle, Appleton, WI (US); Edward John Foley, Greenville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 12/337,777

(22) Filed: Dec. 18, 2008

(65) Prior Publication Data

US 2010/0155284 A1 Jun. 24, 2010

(51) Int. Cl.
*B65D 73/00* (2006.01)
*A47K 10/24* (2006.01)

(52) U.S. Cl. ..... 206/494; 206/449; 206/469; 221/45

(58) Field of Classification Search ..... 206/229, 206/449, 461–462, 469, 484–484.2, 494; 221/45; 222/92, 94, 107; 401/132, 196
See application file for complete search history.

(56) References Cited

U.S. PATENT DOCUMENTS

| | | | | | |
|---|---|---|---|---|---|
| 2,499,313 | A | | 2/1950 | Hoag | |
| 2,956,710 | A | | 10/1960 | O'Connor | |
| 3,472,368 | A | * | 10/1969 | Hellstrom | 206/469 |
| 3,498,448 | A | * | 3/1970 | Kuster | 206/469 |
| 3,521,805 | A | | 7/1970 | Ward | |
| 3,741,384 | A | | 6/1973 | Cloud | |
| 3,811,564 | A | * | 5/1974 | Braber | 206/469 |
| 3,872,970 | A | * | 3/1975 | Edison | 206/469 |
| 3,948,394 | A | | 4/1976 | Hellstrom | |
| 4,158,411 | A | | 6/1979 | Hall et al. | |
| 4,236,652 | A | * | 12/1980 | Beguhn | 222/92 |
| 4,493,574 | A | | 1/1985 | Redmond et al. | |
| 4,724,982 | A | | 2/1988 | Redmond | |
| 4,762,230 | A | * | 8/1988 | Croce | 206/469 |
| 4,803,048 | A | * | 2/1989 | Nason | 206/469 |
| RE34,087 | E | | 10/1992 | Redmond | |

(Continued)

FOREIGN PATENT DOCUMENTS

DE 198 61 214 C2 4/2003

(Continued)

OTHER PUBLICATIONS

"Snap!® Packaging," from Tapemark, Internet web page "http://www.tapemark.com/snap.html", 2007, 1 page.

*Primary Examiner* — Bryon Gehman
(74) *Attorney, Agent, or Firm* — R. Joseph Foster, III

(57) ABSTRACT

A package that is opened by deforming or bending the package along the die cut on the surface of the package is disclosed. The package will fracture or break at a die cut providing an opening in the package to access the contents inside. The package is formed with a semi-rigid layer affixed to a flexible backing layer forming an inner cavity. A die cut extends from at least an area adjacent one edge of the semi-rigid layer to at least an area adjacent another edge of the semi-rigid layer to provide a fracture point for the package to break. At least a portion of the die cut extends along both the lateral width and the longitudinal width of the semi-rigid layer to allow a greater surface area of the substrate to be accessible. Thus, dispensing of the substrate is easier for the user.

14 Claims, 5 Drawing Sheets

U.S. PATENT DOCUMENTS

| | | | | |
|---|---|---|---|---|
| 5,316,400 | A * | 5/1994 | Hoyt et al. | 401/132 |
| 5,395,031 | A | 3/1995 | Redmond | |
| 5,494,192 | A | 2/1996 | Redmond | |
| 5,698,280 | A | 12/1997 | Affolderbach et al. | |
| 5,985,075 | A | 11/1999 | Freedman | |
| 6,156,252 | A | 12/2000 | Freedman | |
| 6,579,602 | B1 | 6/2003 | Freedman | |
| 6,627,283 | B1 | 9/2003 | Freedman | |
| 6,726,054 | B2 * | 4/2004 | Fagen et al. | 221/45 |
| 7,104,419 | B2 * | 9/2006 | Fagen et al. | 206/449 |
| 7,121,409 | B1 * | 10/2006 | Hamilton et al. | 206/484.2 |
| 7,506,762 | B2 * | 3/2009 | Nelson et al. | 206/484.1 |
| 7,552,823 | B2 * | 6/2009 | Schuehrer | 206/484 |
| 2003/0204158 | A1 | 10/2003 | Johnson et al. | |
| 2005/0167311 | A1 * | 8/2005 | Tonsfeldt et al. | 206/449 |

FOREIGN PATENT DOCUMENTS

| | | | |
|---|---|---|---|
| EP | 0 109 737 | B1 | 1/1988 |
| EP | 1 227 047 | A1 | 7/2002 |
| WO | WO 2008/038074 | A2 | 4/2008 |

* cited by examiner

BREAK-OPEN PACKAGE WITH SHAPED DIE CUT FOR STORING AND DISPENSING SUBSTRATES

BACKGROUND

There exist several small packages and sachets for storing and packaging numerous consumer products, including liquids, powders, pastes, and solid objects such as tissues. Frequently, there is a consumer desire to have a package that is highly portable and suitable for placement in the car, the home, a purse, a diaper bag, or other luggage. These packages are small enough to be used in a portable manner. These packages are also generally designed for single use of the contents stored within. However, many of these packages have significant disadvantages.

For example, often packages for use with personal care products such as wipes or tissues require a user to use two hands to open the package. One hand must be used to hold the package while the second hand is used to grip and tear the package. Many people who use these personal care products are care givers. The contents of the dispenser need to be readily accessible without an undue struggle to access the contents when needed. For example, wet wipes are used to clean up spills or during diapering of a child. The dispenser's ease of use is important for these tasks when speed or the capability to open the package using only one hand is an advantage. If the package may be opened with one hand, the process is simpler and the user can use their other hand for other safety or caretaking tasks.

In addition, packages exist that allow for one-handed access to the contents by bending the package to open along weakened lines and gain access to the product. These packages are often used for liquid products that can then be squeezed from the package onto a surface. However, the current packages do not adequately dispense solid products such as wipes or tissues. The weakened lines are straight lines that do not provide adequate space when open to allow a user to grab the wipe and pull from the package. Thus, use of these types of packages may be difficult for a user.

Thus, there is a need for a package that provides adequate access to the contents of the package with the use of only one hand.

SUMMARY

In response to the needs described above, the present disclosure provides a package that is opened by deforming or bending the package along a die cut on the surface of the package. The package will fracture or break at the die cut providing an opening in the package to access the contents contained therein.

In an exemplary aspect, the package is formed with a semi-rigid layer having a lateral width and a longitudinal width, with the semi-rigid layer being affixed to a flexible backing layer to form an inner cavity between the flexible backing layer and the semi-rigid layer. Stored within the inner cavity is a substrate.

In another aspect, a die cut extends from an area adjacent or near at least one edge of the semi-rigid layer to an area adjacent or near another edge of the semi-rigid layer to provide a fracture point for the package to break.

In another aspect, the shape of the die cut may contribute to the ease of use of the package. At least a portion of the die cut extends along the lateral width of the semi-rigid layer and at least a portion of the die cut extends along the longitudinal width of the semi-rigid layer providing a larger space for the package opening when broken. Thus, a greater surface area of the substrate is accessible to be pulled out by the user making dispensing of the substrate easier. The die cut may be several shapes. Shapes for the die cut include curvilinear, straight, v-shaped, rounded configurations, and combinations thereof.

In another aspect, a top layer may be adhered to the semi-rigid layer for printing purposes. The top layer may be adhered to the semi-rigid layer using a resealable adhesive that allows for the package to be resealed if additional substrates remain in the package after initial use. The top layer may also break when the semi-rigid layer breaks.

In a particular aspect, the package has a substantially rectangular shape having at least one lateral edge and at least one longitudinal edge. The package may also be other shapes including, but not limited to, circular, oval, silhouetted (like an outline of a logo, character, or icon), square, triangular, hexagonal and trapezoidal.

Thickness of the semi-rigid layer and the die cut therein may contribute to the ease of use of the package. In an exemplary aspect, the semi-rigid layer has a thickness of between about 0.10 mm and 1.0 mm while the die cut in the semi-rigid plastic layer may have a depth ranging between about 0.075 mm and 0.150 mm.

Location of the die cut may also contribute to the ease of use of the package. In an exemplary aspect, at least a portion of the die cut extends along the lateral width of the package at a position on the semi-rigid layer closer to the lateral edge of the package than a midpoint of the longitudinal edge. In a particular aspect, the die cut extends from the lateral edge to the longitudinal edge of the package.

In another aspect, the semi-rigid layer may be selected from polystyrene, polyethylene, polypropylene, amorphous polyethylene terephthalate, polyethylene copolymers, polycarbonate, methyl methacrylate polymers, butadiene-styrene-acrylonitrile polymers, acrylonitrile-methacrylate with butadiene-acrylonitile copolymer, post consumer recycled content, or plant based materials, and combinations thereof.

In other aspects, the flexible backing layer may be selected from flexible plastic sheeting, polyethylene, paper, metal foil, polyesters such as polyethylene terephthalates, cellophane, polypropylene post consumer recycled content, plant based materials, and combinations thereof.

In other aspects, the substrates stored within the package may include nonwoven substrates, woven substrates, hydroentangled substrates, air-entangled substrates, paper substrates comprising cellulose such as facial tissue, toilet paper, or paper towels, waxed paper substrates, coform substrates, wet wipes, film or plastic substrates, bandages, gauze, and metal substrates.

BRIEF DESCRIPTION

The above aspects and other aspects, features and advantages of the present disclosure will become better understood with regard to the following description, appended claims, and accompanying drawings.

Figure 1:
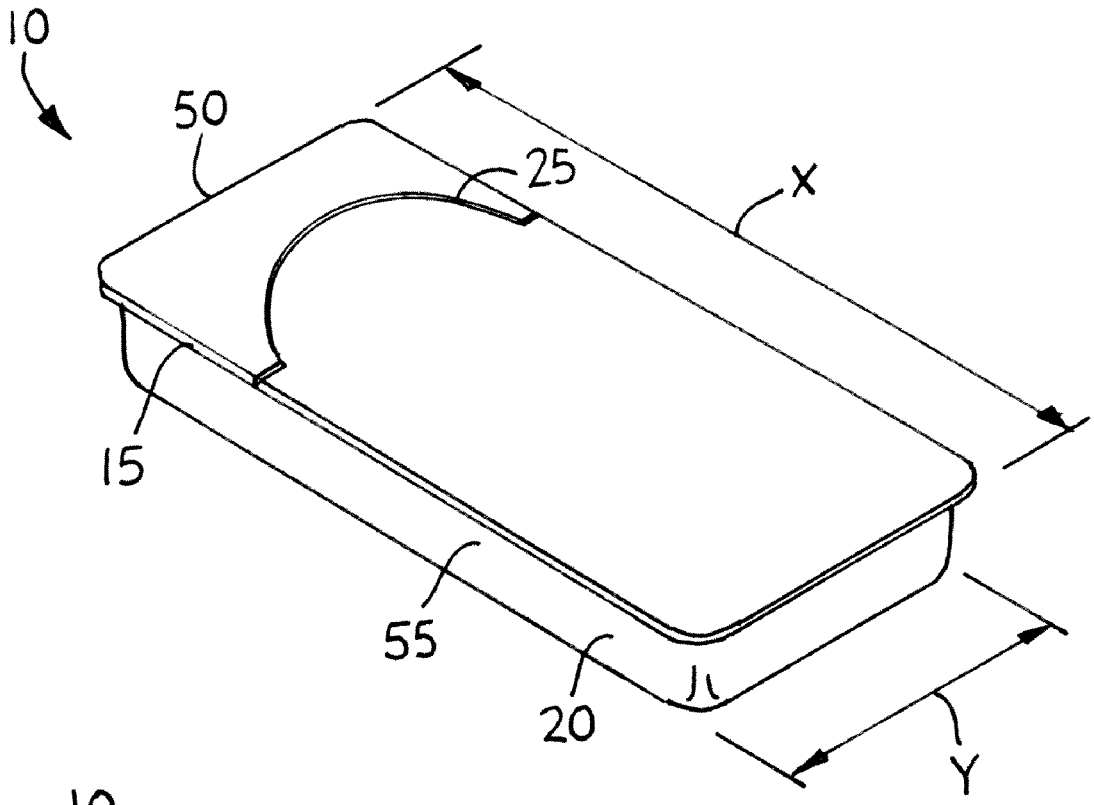
FIG. 1 depicts a perspective view of an exemplary package in the closed position.
Figure 2:
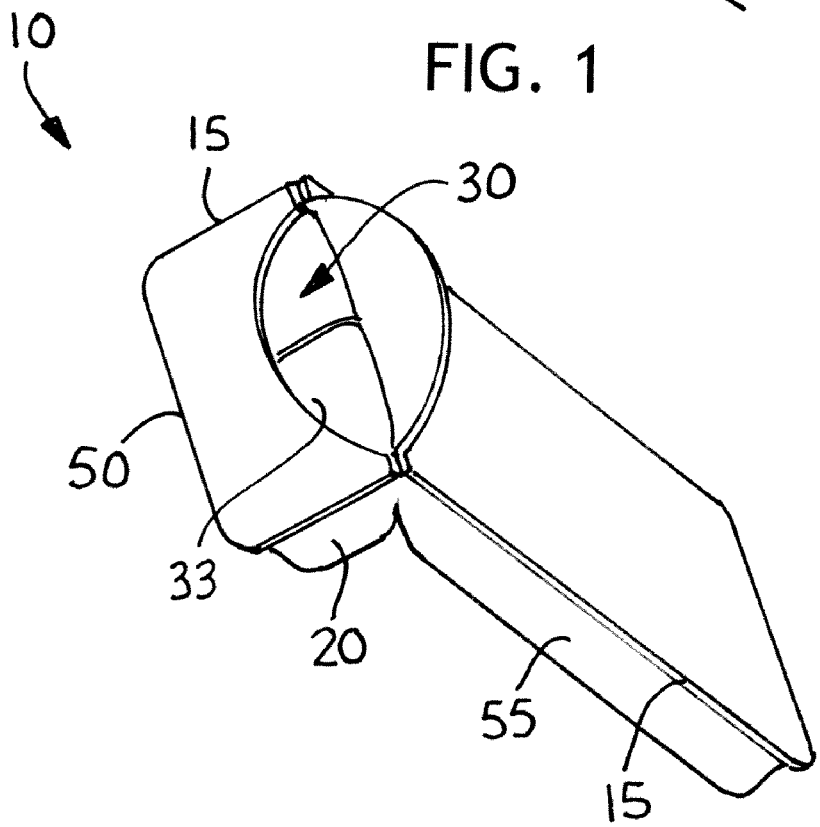
FIG. 2 depicts a perspective view of the exemplary package illustrated in FIG. 1 in the open position.

FIGS. 7*a*-7*d* each depict a top view of an exemplary package showing illustrative shapes and designs for the opening feature of the package.

DETAILED DESCRIPTION

It is to be understood by one of ordinary skill in the art that the present discussion is a description of exemplary packages only and is not intended as limiting the broader aspects of the present invention, which broader aspects are embodied in the exemplary construction.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As used herein, the terminology such as "vertical", "horizontal", "top", "bottom", "front", "back", "end" and "sides" are referenced according to the views presented. It should be understood, however, that the terms are used only for purposes of description, and are not intended to be used as limitations. Accordingly, orientation of an object or a combination of objects may change without departing from the scope of the invention. As a point of reference for the claims and in the present specification, the term "top" refers to a panel or side of the package with an opening device or opening.

As used herein, the term "opening" refers to a portion of the package which allows the substrate to be released from the inner cavity of the package.

Generally speaking, an exemplary package having a shaped die cut formed in a surface thereof and capable of storing a solid substrate is disclosed. The package may be opened by deforming or bending the package at the die cut on the surface of the package. The package will fracture or break at the die cut providing an opening in the package to access the contents. This die cut is shaped to provide access to a greater surface area of the substrate resulting in easier dispensing for a user.

Referring specifically to FIGS. 1-5*d*, a package 10 is formed having a semi-rigid layer 15 having at least a lateral width, represented by "Y" in the figures, and a longitudinal width, represented by "X" in the figures, that is affixed and sealed to a flexible backing layer 20 around the outer peripheral edges of the semi-rigid layer 15 forming an inner cavity 23. The lateral width Y is a distance measurement of the package width 10 in one direction and the longitudinal width X is a distance measurement of the package 10 measured in a direction at a 90 degree angle from the lateral width Y. The semi-rigid layer 15 has a die cut 25 extending from adjacent one edge of the semi-rigid layer 15 to adjacent another edge of the semi-rigid layer 15 that allows for fracture of the semi-rigid layer 15 when bending forces are applied. The die cut 25 is typically a line of weakness formed in the semi-rigid layer. The die cut may also be a slot cut through the semi-rigid layer 15 or a combination of a line of weakness and a slot. An opening 30 provided by fracture of the semi-rigid layer 15 allows access to the substrate 33 stored within the package 10. At least a portion of the die cut 25 extends along both the lateral width Y and at least a portion of the die cut 25 extends along the longitudinal width X of the semi-rigid layer 15 to allow for a sufficiently large surface area of the substrate 33 to be gripped by a user to remove the substrate 33 from the package 10.

The semi-rigid layer 15 of the package 10 can be selected from a wide variety of materials such as plastic or multi-layered laminations of such materials. Suitable materials include, but are not limited to polystyrene, polyethylene, polypropylene, amorphous polyethylene terephthalate, polyethylene copolymers, polycarbonate, methyl methacrylate polymers, butadiene-styrene-acrylonitrile polymers, acrylonitrile-methacrylate with butadiene-acrylonitile copolymer, post consumer recycled content, or plant based materials such as polylactic acid, sugar cane, bamboo, palm, and other similar materials. The semi-rigid layer 15 must be a material that is able to be coated with adhesive or heat sealable plastic coating to facilitate securing the semi-rigid layer 15 to the flexible backing layer 20.

In an exemplary aspect, the semi-rigid layer 15 has a thickness of between about 0.10 mm and 1.0 mm. Desirably, the semi-rigid layer 15 may have a thickness of between about 0.30 mm and 0.70 mm.

The flexible backing layer 20 of the package 10 may include, but is not limited to, flexible plastic sheeting, polyethylene, paper, metal foil, polyesters such as polyethylene terephthalates, cellophane, polypropylene, post consumer recycled content, plant based materials, and combinations of such materials in multi-layered laminations.

The flexible backing layer 20 overlies the semi-rigid layer 15 and is sealed to the semi-rigid layer 15 around the peripheral edges of the semi-rigid layer 15. When sealed, an inner cavity 23 is formed between the semi-rigid layer 15 and the flexible backing layer 20. The flexible backing layer 20 may be sealed to the semi-rigid layer 15 using adhesive bonding, thermal bonding, point bonding, pressure bonding, extrusion coating, or ultrasonic bonding. Desirably, the seal may be an adhesive. Exemplary adhesives include polyolefin hotmelt adhesives and styrenic block-copolymer hotmelt adhesives that would prevent moisture loss through the seal during storage of the package 10.

Figure 3:
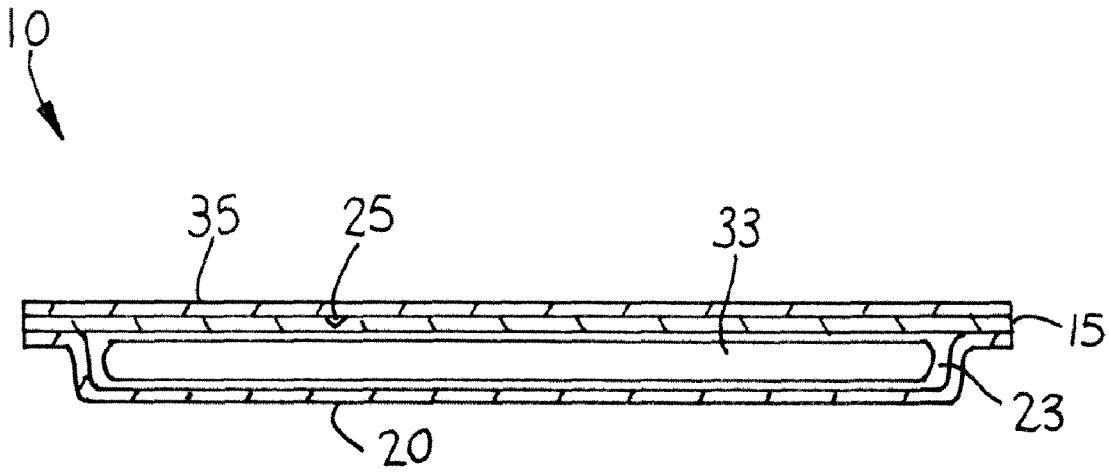
FIG. 3 depicts a cross-sectional view of another exemplary package in the closed position.
Figure 4:
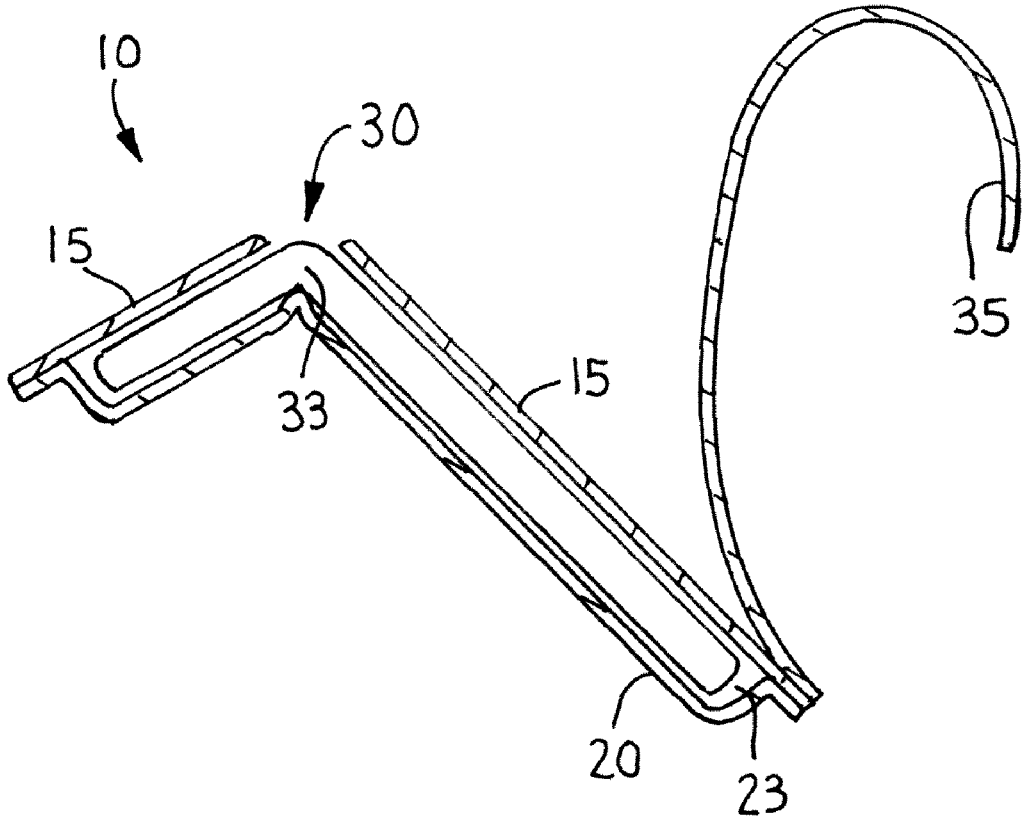
FIG. 4 depicts a cross-sectional view of the exemplary package illustrated in FIG. 3 in the open position.

Referring to FIGS. 3-4, an additional top layer 35 may be adhered to the opposing side of the semi-rigid layer 15. The top layer 35 may be printable to allow printing of product and marketing information thereon to inform the user about the package 10 contents.

As illustrated in FIG. 4, the top layer 35 may be adhered to the semi-rigid layer 15 using a resealable adhesive. This allows the user to peel back the adhesive, open the package 10, and then reseal the package 10 to protect any substrates remaining within the package 10 after the initial use.

Figure 5:
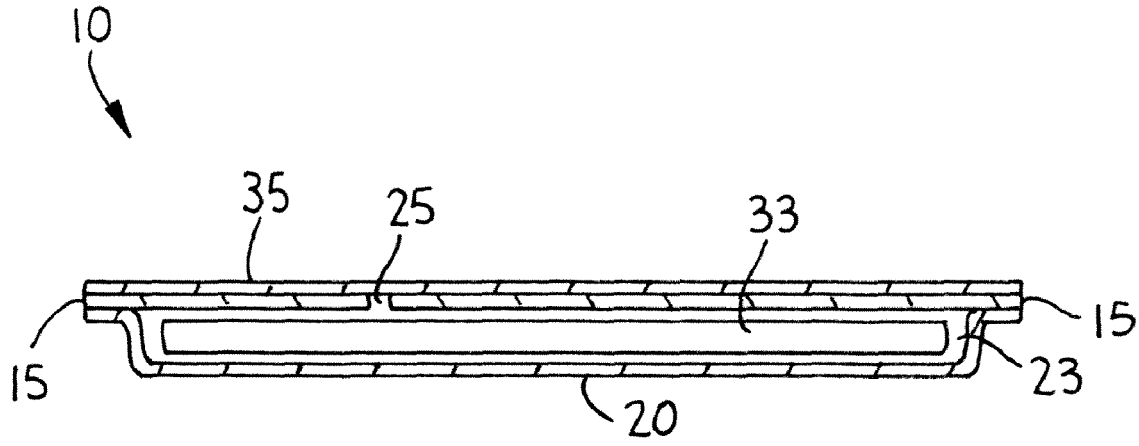
FIG. 5 depicts a cross-sectional view of another exemplary package in the closed position.
Figure 6:
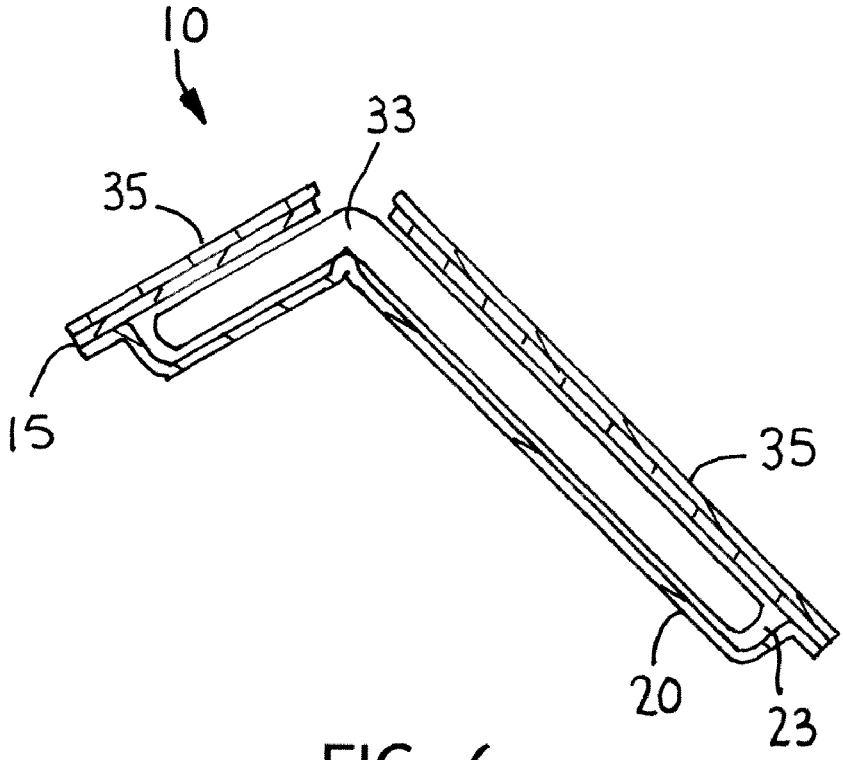
FIG. 6 depicts a cross-sectional view of the exemplary package illustrated in FIG. 3 in the open position.
Figure 7A:
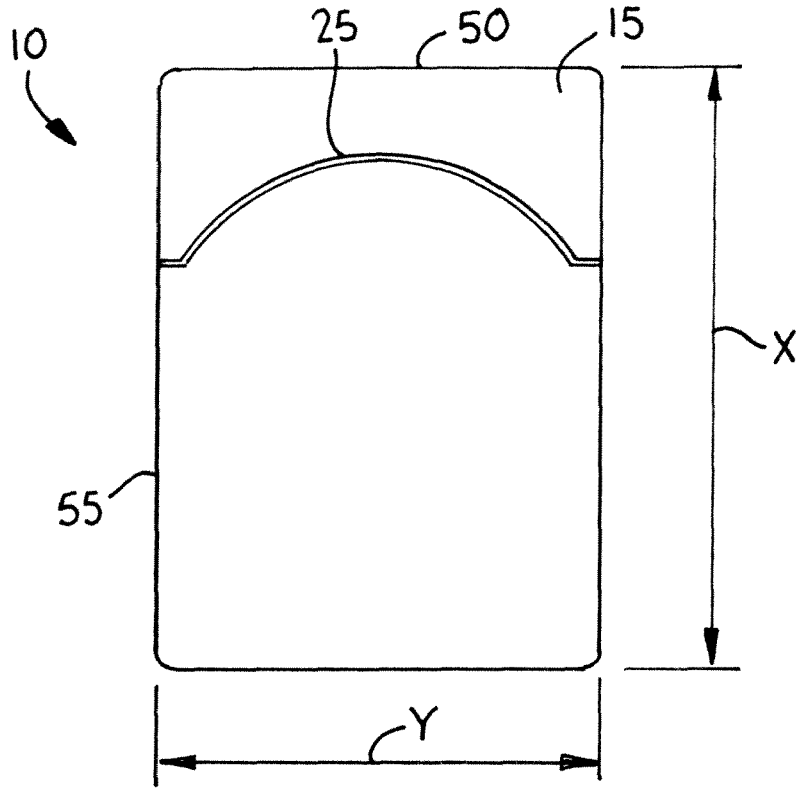
Figure 7B:
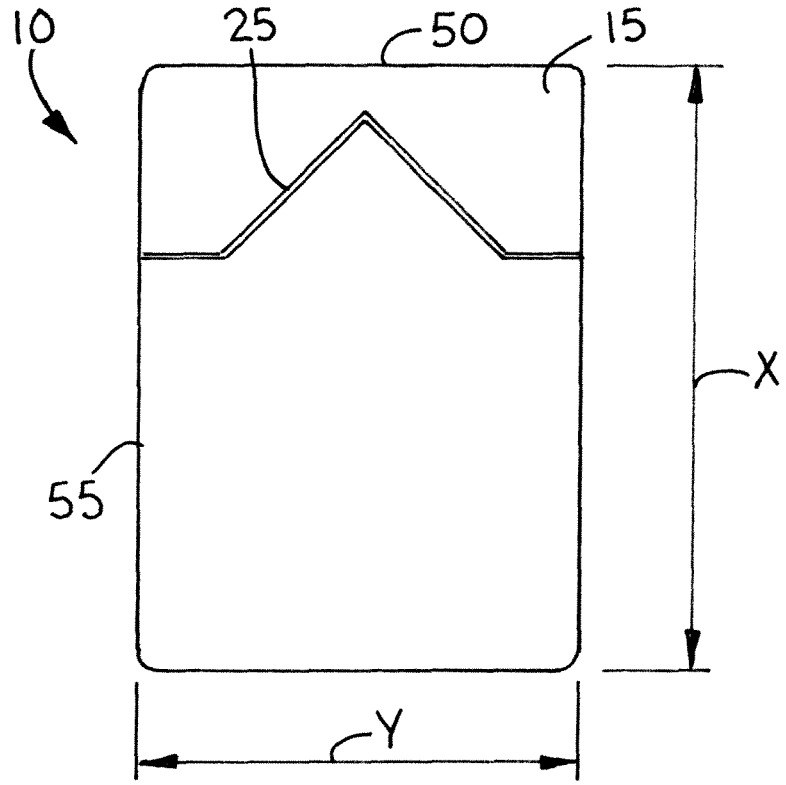
Figure 7C:
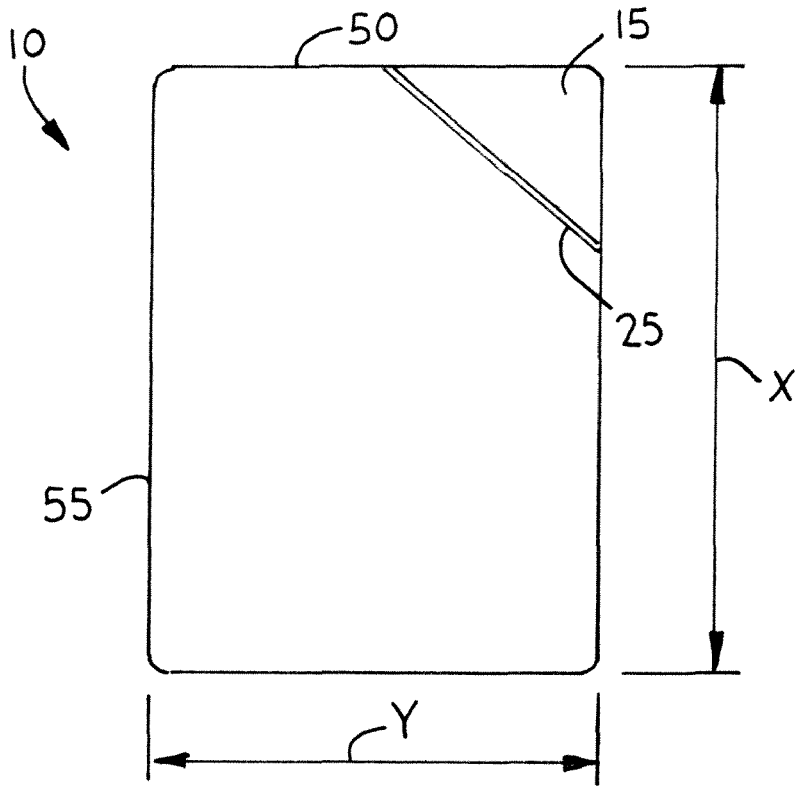
Figure 7D:
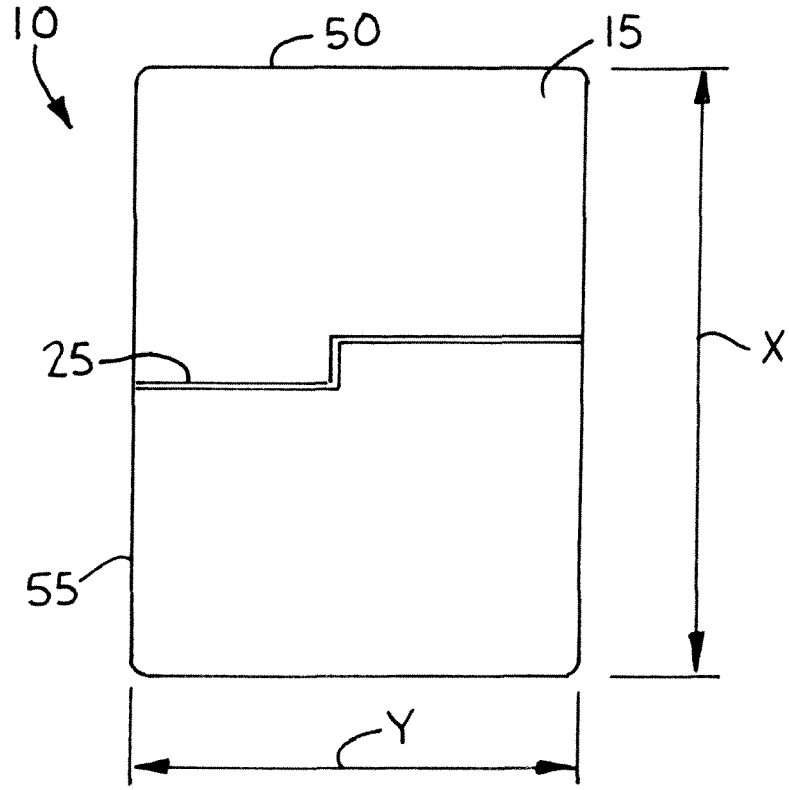

FIGS. 5 and 6 illustrate an alternative package 10. The flexible backing layer 20 overlies the semi-rigid layer 15 and may be sealed to the semi-rigid layer 15 around the peripheral edges of the semi-rigid layer 15. When sealed, an inner cavity 23 is formed between the semi-rigid layer 15 and the flexible backing layer 20. A top layer 35 may be adhered to the semi-rigid layer 15 using an adhesive. As illustrated in FIG. 6, the top layer 35 may be constructed of a material that will break when the semi-rigid layer 15 is manipulated or bent to open the package 10. When a top layer 35 is present on the package 10, the die cut can extend though the semi-rigid layer 15 leaving a gap or fracture area. In other words, a portion of the die cut 25 may be a slot extending through the entire semi-rigid layer 15. The top layer 35 then provides the outer seal to protect the contents of the package 10.

Stored within the inner cavity 23 of the package 10 is a substrate 33. The substrate 33 may be a flexible sheet or web material, which is useful for household chores, personal care, health care, food wrapping, and cosmetic application or removal. Non-limiting examples of suitable substrates of the present invention include nonwoven substrates, woven substrates, hydro-entangled substrates, air-entangled substrates, paper substrates comprising cellulose such as facial tissue, toilet paper, or paper towels, waxed paper substrates, coform substrates, bandages, gauze, wet wipes, film or plastic substrates such as those used to wrap food, and metal substrates such as aluminum foil. Further examples of suitable substrates include a substantially dry substrate (less than 10% by weight of water) containing lathering surfactants and conditioning agents either impregnated into or applied to the substrate such that wetting of the substrate with water prior to use yields a personal cleansing product. Other suitable substrates may have encapsulated ingredients such that the capsules rupture during dispensing or use. Other suitable substrates include dry substrates that deliver liquid when subjected to in-use shear and compressive forces. Furthermore, laminated or plied together substrates of two or more layers of any of the preceding substrates are suitable.

The package 10 is sized to provide enough of the substrate 33 for a single use. In an exemplary aspect, the substrate 33 stored in the package 10 is a single folded wet wipe. In other aspects, it may be desirable to have several substrates that are stacked within the package 10 enabling a user to use more than one substrate if needed. For example, wet wipes for use in the bathroom or for use in diaper changing may require more than one wipe. In this case, numerous wipes are stacked within the package 10 allowing a user to use multiple wipes at a time.

In one aspect, the semi-rigid layer 15 has a die cut 25 formed therein. The die cut 25 allows for fracture of the semi-rigid layer 15 when bending forces are applied by a user. Once the semi-rigid layer 15 fractures, a user has access to the substrate 33 through an opening 30 within the package 10. The purpose of the die cut 25 is to define the path at which the semi-rigid layer 15 will break and provide an opening 30 into the package 10.

The die cut 25 extends from near or adjacent one edge of the semi-rigid layer 15 to across the package 10 near or adjacent another edge of the semi-rigid layer 15. In other words, the die cut may be formed so that the die cut 25 is spaced away from the edge of the semi-rigid layer 15, slightly away from the peripheral seal of the package 10. In another aspect, the semi-rigid layer 15 has a die cut 25 formed therein which extends from at least one edge of the semi-rigid layer 15 to another edge of the semi-rigid layer 15.

In exemplary aspects, the positioning, the depth, and the shape of the die cut 25 may all have an effect on the ability of the package opening 30 to provide adequate access to the stored substrate 33.

In one exemplary aspect, the semi-rigid layer 15 maintains enough rigidity to mitigate breakage of the package 10 while stored in a purse or diaper bag. There is also a die cut 25 formed in the semi-rigid layer that is deep enough to allow for the semi-rigid layer 15 to bend and fracture at the die cut 25. For example, the depth of the die cut 25 in the semi-rigid layer 15 may have a depth ranging between about 0.075 mm and 0.150 mm.

In another aspect, when a top layer 35 is also on the package, the die cut 25 may extend through the entire thickness of the semi-rigid layer 15 leaving a gap or fracture area to provide an easy fracture point for the package 10.

The location of the die cut 25 on the surface of the package 10 may provide an increase in the ability of the package 10 to dispense the substrates. The position of the die cut 25 may be located to provide the optimum point for the extraction of a substrate. For example, while the package 10 may have any shape designed to hold the substrate 33 inside, in an exemplary aspect, the package 10 has a rectangular shape having a lateral edge 50 and a longitudinal edge 55 as illustrated in FIGS. 5*a*-5*d*. The package may also be other shapes including, but not limited to, circular, oval, silhouetted (like an outline of a logo, character, or icon), square, triangular, hexagonal and trapezoidal.

As illustrated in FIGS. 5*a*-5*c*, the die cut 25 extends across the lateral width Y of the package 10 near the lateral edge 50 of the package 10. Desirably, at least a portion of the die cut 25 extends along the lateral width Y of the package 10 at a position on the semi-rigid layer 15 closer to the lateral edge 50 of the package 10 than the midpoint of the longitudinal edge 55. As a result, a user may be able to grab an end of the substrate 33 making it easier to pull the substrate from the package 10.

Alternatively, as illustrated in FIG. 5*d*, the die cut 25 extends across the lateral width Y of the of the package near a midpoint of the longitudinal edge 50. Placing the die cut 25 near the midpoint of the longitudinal edge 50 may enable the user to easily open the package by providing bending forces on the die cut 25.

In another aspect, the shape of the die cut 25 provides easy access to the contents inside. At least a portion of the die cut 25 extends along the lateral width Y of the semi-rigid layer 15 and at least a portion of the die cut 25 extends along the longitudinal width X of the semi-rigid layer 15. This allows for the opening 30 to provide a sufficiently large surface area of the substrate 33 for a user to grip and remove the substrate 33 from the package 10. Many die cut configurations are suitable including, without limitation, curvilinear die cuts, v-shaped die cuts, or straight die cuts, or combinations hereof, extending from an area adjacent or near a lateral edge 50 to an area adjacent or near a longitudinal edge 55.

Illustrative examples of different configurations for the die cuts are depicted in FIGS. 5*a*-5*d*. For example, as shown in FIG. 5*a*, the die cut 25 is a half-circle, the circle extending in the longitudinal width X as well as the lateral width Y of the semi-rigid layer 15. As illustrated in FIG. 5*b*, the die cut 25 is a v-shaped line extending in the longitudinal width X as well as the lateral width Y of the semi-rigid layer 15. FIG. 5*c* illustrates another die cut 25 that is a straight line extending from the longitudinal edge 55 to the lateral edge 50. FIG. 5*d* illustrates another alternative shape for the die cut 25 that extends in the longitudinal width X as well as the lateral width Y of the semi-rigid layer 15.

To gain access to the substrate 33 stored within the package 10, a user may use one hand to expose the package 10 to bending forces at the die cut 25 until the point of fracture of the semi-rigid layer 15. A second hand is not needed to rip open the package 10. As the semi-rigid layer 15 fractures, an opening 30 in the package 10 is provided allowing a user to grip the substrate 33 and pull the substrate 33 from the package 10. The flexible backing layer 20 remains intact, though bent, and continues to contain the substrate. The shape and location of the die cut 25 contributes to the breakage of the package 10 resulting in the removal of the semi-rigid layer 15 away from the substrate 33. A large surface area of the substrate 33 is exposed through the opening 30 of the package 10. Since a sufficient large surface area of the substrate 33 is accessible for a user to grip the substrate 33, a user is more easily able to remove the substrate 33 from the package 10.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. The preceding description, given by way of example in order to enable one of ordinary skill in the art to practice the claimed invention, is not to be construed as limiting the scope of the invention, which is defined by the claims and all equivalents thereto.

The invention claimed is:

1. A package comprising:

a semi-rigid layer having a lateral width and a longitudinal width;

a flexible backing layer affixed to the semi-rigid layer forming an inner cavity between the flexible backing layer and the semi-rigid layer;

a substrate stored within the inner cavity wherein the substrate within the package is selected from nonwoven substrates, woven substrates, hydro-entangled substrates, air-entangled substrates, paper substrates comprising cellulose, facial tissue, toilet paper or paper towels, waxed paper substrates, coform substrates, wet wipes, film or plastic substrates, bandages, gauze, and metal substrates;

a die cut formed in the semi-rigid layer, wherein bending the package along the die cut causes a break at the die cut and provides an opening into the inner cavity that retains the substrate within the cavity but allows for direct access to the inner cavity allowing a user to grip an edge of the substrate without tearing open the package;

wherein at least a portion of the die cut extends along the lateral width of the semi-rigid layer and at least a portion of the die cut extends along the longitudinal width of the semi-rigid layer closer to a lateral edge of the package than a midpoint of a longitudinal edge of the package.

2. The package of claim 1 further comprising a top layer adhered to the semi-rigid layer.

3. The package of claim 2 wherein the top layer is adhered to the semi-rigid layer using a resealable adhesive.

4. The package of claim 2 wherein at least a portion of the die cut extends through the entire semi-rigid layer.

5. The package of claim 1 wherein the semi-rigid layer has a thickness of between about 0.10 mm and 1.0 mm.

6. The package of claim 1 wherein the die cut in the semi-rigid plastic layer having a depth ranging between about 0.075 mm and 0.150 mm.

7. The package of claim 1 wherein the die cut is curvilinear.

8. The package of claim 1 wherein the die cut has a v-shaped configuration.

9. The package of claim 1 wherein the die cut has a rounded configuration.

10. The package of claim 1 wherein the semi-rigid layer has a substantially rectangular shape having a lateral edge and a longitudinal edge.

11. The package of claim 1 wherein the die cut extends from adjacent a lateral edge to adjacent a longitudinal edge of the package.

12. The package of claim 1 wherein the die cut extends from at least one edge of the semi-rigid layer to another edge of the semi-rigid layer.

13. The package of claim 1 wherein the semi-rigid layer is selected from polystyrene, polyethylene, polypropylene, amorphous polyethylene terephthalate, polyethylene copolymers, polycarbonate, methyl methacrylate polymers, butadiene-styrene-acrylonitrile polymers, acrylonitrile-methacrylate with butadiene-acrylonitile copolymer, post consumer recycled content, and plant based materials, and combinations thereof.

14. The package of claim 1 wherein the flexible backing layer is selected from flexible plastic sheeting, polyethylene, paper, metal foil, polyesters such as polyethylene terephthalates, cellophane, polypropylene, post consumer recycled content, and plant based materials, and combinations thereof.

* * * * *